US012765691B2

(12) United States Patent
Wuerthele

(10) Patent No.: US 12,765,691 B2
(45) **Date of Patent: *Oct. 20, 2026**

(54) AIR MATTRESS WITH AUTOMATIC PITCH ADJUSTMENT

(71) Applicant: Toyota Motor Engineering & Manufacturing North America, Inc., Plano, TX (US)

(72) Inventor: Stuart R. Wuerthele, Saline, MI (US)

(73) Assignees: Toyota Motor Engineering & Manufacturing North America, Inc., Plano, TX (US); Toyota Jidosha Kabushiki Kaisha, Toyota (JP)

( * ) Notice: Subject to any disclaimer, the term of this patent is extended or adjusted under 35 U.S.C. 154(b) by 0 days.

This patent is subject to a terminal disclaimer.

(21) Appl. No.: 19/170,751

(22) Filed: Apr. 4, 2025

(65) Prior Publication Data

US 2025/0228374 A1 Jul. 17, 2025

Related U.S. Application Data

(63) Continuation of application No. 18/086,063, filed on Dec. 21, 2022, now Pat. No. 12,290,180.

(51) Int. Cl.
*A47C 27/08* (2006.01)
*A47C 27/10* (2006.01)

(52) U.S. Cl.
CPC ..... *A47C 27/083* (2013.01); *A47C 27/082* (2013.01); *A47C 27/10* (2013.01); *A47C 27/081* (2013.01)

(58) Field of Classification Search
CPC ..... A47C 27/083; A47C 27/08; A47C 27/081; A47C 27/082; A47C 27/10; A61G 7/057; A61G 7/05769
USPC ..... 5/710, 713, 706, 655.3, 654, 644
See application file for complete search history.

(56) References Cited

U.S. PATENT DOCUMENTS

| | | | |
|---|---|---|---|
| 2,169,117 | A | 8/1939 | Utermohlen |
| 4,979,248 | A | 12/1990 | Kelley |
| 6,505,363 | B2 | 1/2003 | Davis |
| 6,671,900 | B2 | 1/2004 | Davis |

(Continued)

FOREIGN PATENT DOCUMENTS

| | | | |
|---|---|---|---|
| CN | 208149462 | U | 11/2018 |
| EP | 2735293 | B1 | 9/2015 |
| WO | 2020067836 | A1 | 4/2020 |

*Primary Examiner* — Robert G Santos
(74) *Attorney, Agent, or Firm* — Dinsmore & Shohl LLP

(57) ABSTRACT

An adjustable air mattress includes a plurality of air chambers having a sleeping surface, an electronic control unit, and an air pump communicatively coupled to the electronic control unit and fluidly coupled to the plurality of air chambers. A plurality of air valves are communicatively coupled to the electronic control unit and are configured to permit or inhibit a release of air within each respective air chambers. A plurality of level sensors are communicatively coupled to the electronic control unit, determine an angle of the sleeping surface, and determine whether the angle of the sleeping surface is within a predetermined level range. When the angle of the sleeping surface is not within the predetermined level range, the electronic control unit controls at least one of the air pump and the plurality of air valves to adjust an amount of air in at least one of the plurality of air chambers.

10 Claims, 3 Drawing Sheets

(56) References Cited

U.S. PATENT DOCUMENTS

| | | | | |
|---|---|---|---|---|
| 6,718,574 | B1 | 4/2004 | Bradley | |
| 6,993,798 | B1 | 2/2006 | Roberts | |
| 7,146,662 | B1 | 12/2006 | Pollard | |
| 7,418,751 | B1 | 9/2008 | Bartlett et al. | |
| 7,509,699 | B1 | 3/2009 | Tresenfeld | |
| 7,596,823 | B2 | 10/2009 | Friedrichs | |
| 11,399,636 | B2 | 8/2022 | Demirli et al. | |
| 12,290,180 | B2 * | 5/2025 | Wuerthele | A47C 27/10 |
| 2001/0044959 | A1 | 11/2001 | Davis | |
| 2002/0078500 | A1 | 6/2002 | Davis | |
| 2019/0290016 | A1 | 9/2019 | Miller, Jr. | |
| 2022/0265059 | A1 | 8/2022 | Palashewski et al. | |
| 2024/0206638 | A1 | 6/2024 | Wuerthele | |
| 2025/0228374 | A1 * | 7/2025 | Wuerthele | A47C 27/083 |

* cited by examiner

AIR MATTRESS WITH AUTOMATIC PITCH ADJUSTMENT

CROSS-REFERENCE TO RELATED APPLICATIONS

This application is a continuation of U.S. patent application Ser. No. 18/086,063 filed Dec. 21, 2022, now U.S. Pat. No. 12,290,180, which is incorporated herein by reference in its entirety.

FIELD

The embodiments described herein generally relate to an air mattress system, in particular, to an air mattress system with a pitch adjustment that automatically creates a level sleeping surface.

BACKGROUND

As background, air mattresses utilize air to inflate to a uniform thickness. A user may adjust the amount of air in an air mattress through an air pump; the more air is pumped into the air mattress, the firmer it will be. Moreover, air mattresses are often used for recreational activities, such as camping, when carrying a non-inflatable mattress would be impracticable. However, users often have difficulty sleeping when the air mattress is on an unleveled surface, such as a hill or a rock. Users are not always able to find a level surface to place the air mattress and if the user is forced to sleep at an incline, the user may sleep uncomfortably or even roll off of the air mattress. Current air mattresses allow only for an increase or decrease in firmness of the air mattress, not an automatic leveling of the air mattress.

Accordingly, a need exits for an adjustable air mattress capable of automatically adjusting its sleeping surface to be level through the use of multiple air chambers and a plurality level sensors.

SUMMARY

In accordance with one embodiment, an adjustable air mattress is provided. The adjustable air mattress includes a plurality of air chambers having a sleeping surface, an electronic control unit, and an air pump communicatively coupled to the electronic control unit. The air pump is fluidly coupled to the plurality of air chambers. The adjustable air mattress also includes a plurality of air valves communicatively coupled to the electronic control unit and the plurality of air valves are configured to permit or inhibit a release of air within each respective air chambers. A plurality of level sensors are communicatively coupled to the electronic control unit and the plurality of level sensors determine an angle of the sleeping surface. The plurality of level sensors determine whether the angle of the sleeping surface is within a predetermined level range and when it is determined that the angle of the sleeping surface is not within the predetermined level range, the electronic control unit controls at least one of the air pump and the plurality of air valves to adjust an amount of air in at least one of the plurality of air chambers.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Embodiments described herein generally related to adjustable air mattresses to produce a level sleeping surface when a plurality of level sensors determine that an angle of the sleeping surface is not within a predetermined level range. One non-limiting example of an adjustable air mattress includes a plurality of air chambers having a sleeping surface, an electronic control unit, and an air pump communicatively coupled to the electronic control unit; the air pump is also fluidly coupled to the plurality of air chambers.

The adjustable air mattress also includes a plurality of air valves communicatively coupled to the electronic control unit, where the plurality of air valves are configured to permit or inhibit a release of air within each respective air chambers. The adjustable air mattress also includes a plurality of level sensors communicatively coupled to the electronic control unit. The plurality of level sensors determine an angle of the sleeping surface. The adjustable air mattress further includes that the plurality of level sensors determine whether the angle of the sleeping surface is within a predetermined level range and when it is determined that the angle of the sleeping surface is not within the predetermined level range, the electronic control unit controls at least one of the air pump and the plurality of air valves to adjust an amount of air in at least one of the plurality of air chambers.

As used herein, the terms "distal" and "proximal" are used to describe the relative positioning of various components of the system.

Figure 1:
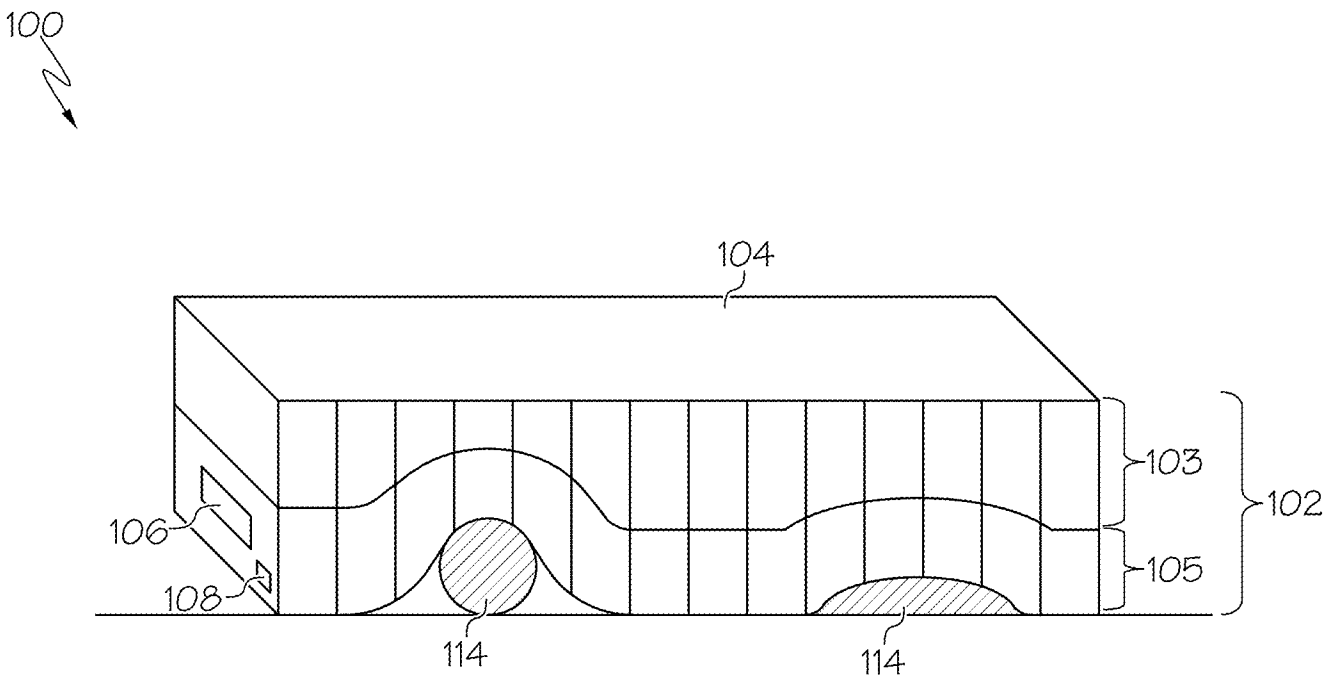
FIG. 1 depicts an adjustable air mattress placed on a plurality of obstacles, according to one or more embodiments illustrated and described herein.

Referring to FIG. 1, an adjustable air mattress 100 is provided. The adjustable air mattress 100 includes a plurality of air chambers 102. The plurality of air chambers 102 include a sleeping surface 104. The adjustable air mattress 100 also includes an electronic control unit 106 and an air pump 108. The adjustable air mattress 100 may be situated over a plurality of obstacles 114.

Figure 2:
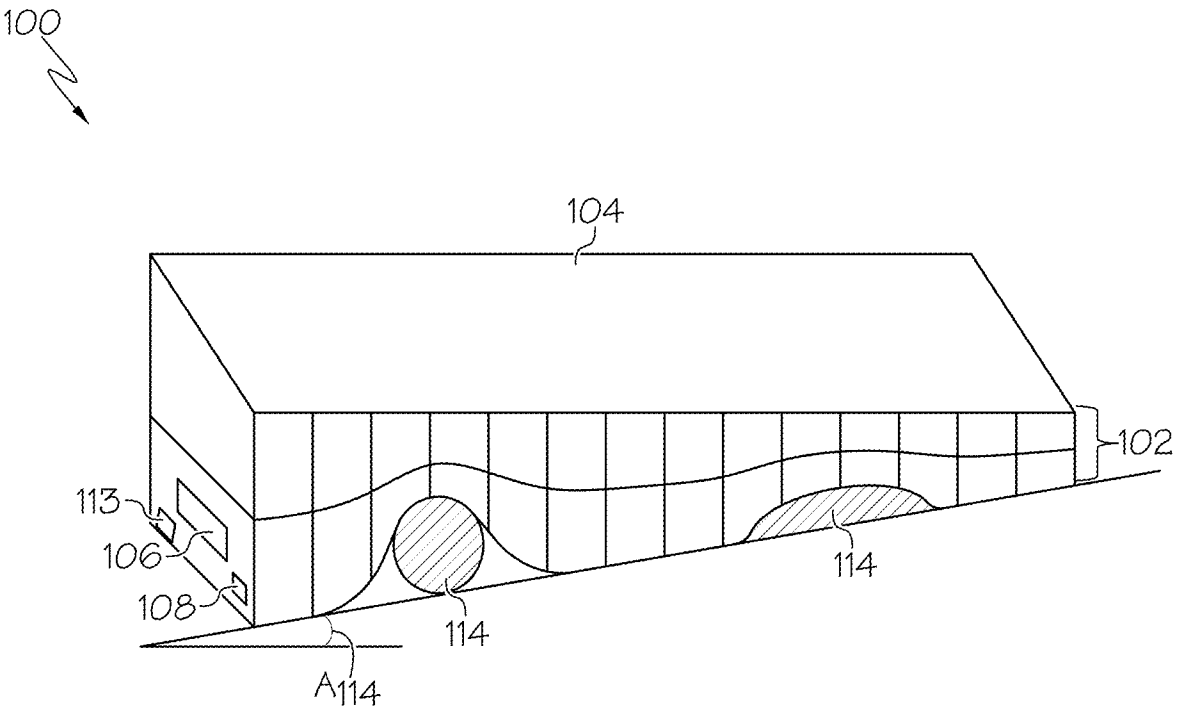
FIG. 2 depicts the adjustable air mattress placed on the plurality of obstacles and at an angle, according to one or more embodiments illustrated and described herein.
Figure 3:
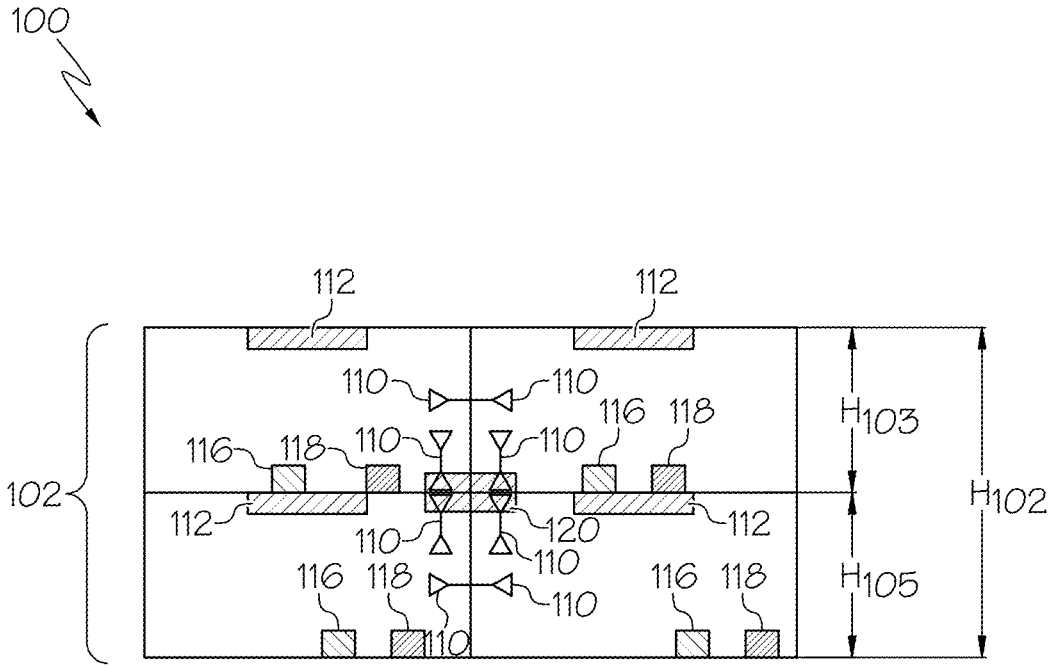
FIG. 3 depicts a cross-section of the adjustable air mattress depicting a plurality of air valves, a plurality of level sensors, a plurality of height sensors, a plurality of pressure sensors, and an outlet conduit, according to one or more embodiments illustrated and described herein.

Referring now to FIG. 2, the adjustable air mattress 100 may also be situated on an angle $A_{114}$. The adjustable air mattress 100 may further include a plurality of air valves 110, a plurality of level sensors 112, and an outlet conduit 120, as depicted in FIG. 3. The adjustable air mattress 100 may also include a battery 113, a plurality of pressure sensors 116, and a plurality of height sensors 118.

The plurality of air chambers 102 include a fluid, most commonly an amount of air, housed within a volume of the plurality of air chambers 102. Accordingly, the plurality of air chambers 102 may be made of polyethylene, rubber, a combination thereof, or any material with sufficient durability capable of housing the fluid.

The plurality of air chambers 102 may be arranged in any way that is able to provide a level sleeping surface 104. As a non-limiting example, there are twenty-eight of the plurality of air chambers 102 evenly spaced in two layers, as depicted in FIG. 1. There may any number of the plurality of air chambers 102 arranged in two, three, or more layers below the sleeping surface 104. The plurality of air chambers 102 may include a head chamber or a leg chamber. The head chamber may inflate at a proximal end of the adjustable air mattress 100 to make the sleeping surface 104 unleveled to elevate a user's head. The leg chamber may inflate at a distal end of the adjustable air mattress 100 to make the sleeping surface 104 unleveled to elevate the user's legs or feet.

The plurality of air chambers 102 include the sleeping surface 104 on an upper layer 103 of the plurality of air chambers 102. The sleeping surface 104 provides an area for the user to sit or lay down. The plurality of air chambers 102 may provide a sleeping surface 104 of a standard bed dimension (i.e. twin, full, queen, king), or any other suitable dimension. In some embodiments, the sleeping surface 104 may be on the upper layer 103 and a bottom layer 105 of the plurality of air chambers 102. This would make the adjustable air mattress 100 reversible, permitting the user to sleep on the sleeping surface 104 on the upper layer 103 of the plurality of air chambers 102, or on the sleeping surface 104 on the bottom layer 105 of the plurality of air chambers 102.

Referring again to FIG. 1, the electronic control unit 106 is mechanically coupled to the plurality of air chambers 102. The electronic control unit 106 may be any device capable of executing a machine-readable instruction set stored in a computer readable memory. Accordingly, the electronic control unit 106 may be an electric controller, an integrated circuit, a mircrochip, a computer, or any other computing device.

The adjustable air mattress 100 also includes the air pump 108. The air pump 108 is communicatively coupled to the electronic control unit 106; this allows for the electronic control unit 106 to control operation of the air pump 108. The air pump 108 is also fluidly coupled to the plurality of air chambers 102. The air pump 108 provides the plurality of air chambers 102 with the fluid (i.e. air from the atmosphere) that is housed within the volume of the plurality of air chambers 102. The air pump 108 may have an air flow rate from about 100 liters per minute to 2,000 liters per minute. The air pump 108 may be capable of providing the fluid to the plurality of air chambers 102 at a set air flow rate, or the air pump 108 may be capable of providing the fluid to the plurality of air chambers 102 at varying flow rates. In other embodiments, the air pump 108 may be configured to either direct the fluid into the plurality of air chambers 102 or pull the fluid out of the plurality of air chambers 102.

In some embodiments, as depicted in FIG. 1, the air pump 108 may be integrated into one of the plurality of air chambers 102. For example, the air pump 108 may be housed in a portion of the volume of one of the plurality of air chambers 102. The battery 113 may also be integrated into the plurality of air chambers 102, such that the battery 113 is housed in a portion of the volume of one of the plurality of air chambers 102. The air pump 108 may also be mechanically coupled to the plurality of air chambers 102, such that the air pump 108 does not take up any of the volume of the plurality of air chambers 102. The air pump 108 may also be separate from the plurality of air chambers 102. For example, the air pump 108 may fluidly couple to an aperture of the plurality of air chambers 102. The air pump 108 may provide the fluid through the aperture, and then be disconnected from the aperture and the air pump 108 may be stored separately from the plurality of air chambers 102. The air pump 108 may be powered by the battery 113, through a connection to an electrical outlet, or any other suitable powering means.

As depicted in FIG. 3, the adjustable air mattress 100 may also include the plurality of air valves 110. The plurality of air valves 110 are communicatively coupled to the electronic control unit 106. The plurality of air valves 110 fluidly couple the plurality of air chambers 102 to one another such that the plurality of air valves 110 are configured to permit or inhibit a release of the fluid into each of the respective plurality of air chambers 102.

The plurality of air valves 110 may fluidly couple adjacent air chambers 102 within the upper layer 103 or the bottom layer 105. In some embodiments, the plurality of air valves 110 may fluidly couple air chambers 102 of the upper layer 103 to adjacent air chambers 102 of the bottom layer 105. The plurality of air valves 110 may be air-release valves, air/vacuum valves, combination air valves, or any other suitable valves.

Referring again to FIG. 3, the adjustable air mattress 100 also includes a plurality of level sensors 112. The plurality of level sensors 112 are communicatively coupled to the electronic control unit 106. The plurality of level sensors 112 determine an angle at which the sleeping surface 104 is situated. For example, the plurality of level sensors 112 may be calibrated that 90 degrees from the direction of the force of gravity is a leveled position. If the sleeping surface 104 is at an angle other than 90 degrees from the direction of the force of gravity, the plurality of level sensors 112 are able to determine the angle at which the sleeping surface 104 surface is situated. In another embodiment, the sleeping surface 104 may be at an angle due to the plurality of obstacles 114. The plurality of obstacles 114 may be a rock, branch, or any other obstacle that would cause the sleeping surface 104 to be unleveled. The plurality of level sensors 112 may also be calibrated such that the leveled position is one other than 90 degrees from the direction of the force of gravity. For example, the leveled position could be parallel with a horizontal direction of the ground.

As discussed hereinabove, the plurality of level sensors 112 may measure the angle at which the sleeping surface 104 is situated with respect to the leveled position, which is 90 degrees from the direction of force of gravity. The plurality of level sensors 112 may measure this angle in a variety of ways. The plurality of level sensors 112 may be inclinometers, tilt sensors, or any other suitable level sensor. In one embodiment, each of the plurality of level sensors 112 may have a first electrode and a second electrode. The first electrode may be fixed, while the second electrode may be movable. A capacitance between the first electrode and the second electrode may be measured. When the plurality of level sensors 112 are in the leveled position, a first capacitance between the first electrode and second electrode is measured and stored as the leveled position. A second capacitance between the first electrode and the second electrode may be measured when the plurality of level sensors 112 are tilted away from the leveled position. A difference in capacitance between the first capacitance and the second capacitance is then used to calculate the angle at which the sleeping surface 104 is situated. The plurality of level sensors 112 may also measure the angle at which the sleeping surface 104 is situated through any other suitable level sensor.

After the plurality of level sensors 112 have determined the angle at which the sleeping surface 104 is situated, the electronic control unit 106 determines whether the angle is within a predetermined level range for example ±1°, ±5°, ±10°, ±15° from the leveled position. The predetermined level range includes a predetermined acceptable angle. If the angle at which the sleeping surface 104 is situated is within the predetermined level range, the electronic control unit 106 takes no action. Alternatively, if the angle at which the sleeping surface 104 is situated is not within the predetermined level range, the electronic control unit 106 controls at least one of the air pump 108 and the plurality of air valves 110 to adjust the fluid in at least one of the plurality of air chambers 102 to level the sleeping surface 104. The predetermined level range maybe plus or minus one degree, five degrees, ten degrees, fifteen degrees, or any other suitable angle.

For example, the predetermined level range may be ten degrees. If the angle at which the sleeping surface 104 is situated is greater than ten degrees, the electronic control 106 unit will control at least one of the air pump 108 and the plurality of air valves 110 to adjust the sleeping surface 104 to be within ten degrees of the leveled position. If the angle at which the sleeping surface 104 is situated is less than ten degrees, the electronic control 106 unit may take no action. In other embodiments, the electronic control unit 106 may be configured to adjust the sleeping surface 104 to a predetermined angle that is not leveled, such as when the user prefers to sleep on a slight incline.

Referring to FIG. 3, the adjustable air mattress 100 may also include the plurality of pressure sensors 116. The plurality of pressure sensors 116 may be communicatively coupled to the electronic control unit 106. The plurality of pressure sensors 116 may measure a pressure within the plurality of air chambers 102. If the pressure within one of the plurality of air chambers 102 is greater than a predetermined maximum pressure, the electronic control unit 106 may control at least one of the air pump 108 and the plurality of air valves 110 to adjust the pressure in the plurality of air chambers 102 so that the predetermined maximum pressure is not exceeded. In this way, the plurality of pressure sensors 116 prevent the bursting of the plurality of air chambers 102.

The adjustable air mattress 100 may also include the plurality of height sensors 118. The plurality of height sensors 118 may be communicatively coupled to the electronic control unit 106. The plurality of height sensors 118 may measure a height $H_{102}$ of the plurality of air chambers 102, a height $H_{105}$ of the bottom layer 105, and a height $H_{103}$ of the top layer 103. If the height $H_{105}$ of one of the plurality of air chambers 102 of the bottom layer 105 is below a predetermined minimum height, the electronic control unit 106 may inhibit air from being released from the plurality of air chambers 102 of the bottom layer 105 so that the predetermined minimum height of the bottom layer 105 is not subceeded, and the electronic control unit 106 may control at least one of the air pump 108 and the plurality of air valves 110 to adjust the height $H_{103}$ of the plurality of air chambers 102 of the top layer 103 to provide the sleeping surface 104 at the leveled position. The predetermined minimum height may be based on the height $H_{102}$ of the plurality of air chambers 102, the height $H_{105}$ of the bottom layer 105, or the height $H_{103}$ of the top layer 103. The predetermined minimum height may be a fourth, third, or half of the height $H_{102}$ when the plurality of air chambers 102 are fully inflated.

The electronic control unit 106 may adjust the angle at which the sleeping surface 104 is situated by first adjusting the height $H_{105}$ of the bottom layer 105. If the height $H_{105}$ of the bottom layer 105 reaches the predetermined minimum height, the electronic control unit 106 may then adjust the height $H_{103}$ of the top layer 103 to adjust the angle at which the sleeping surface 104 is situated until the predetermined minimum height for the top layer 103 is reached.

Referring again to FIG. 3, the adjustable air mattress 100 may include the outlet conduit 120. The outlet conduit 120 may be fluidly coupled to each of the plurality of air chambers 102 and also fluidly coupled to the atmosphere, such that the outlet conduit 120 releases air out of the plurality of air chambers 102 and into the atmosphere. The outlet conduit 120 may be fluidly coupled to the plurality of air chambers 102 through the plurality of air valves 110. In other embodiments, the outlet conduit 120 is fluidly coupled to less than each of the plurality of air chambers 102. The electronic control unit 106 may control the plurality of air valves 110 to release the fluid from the plurality of air chambers 102 to the outlet conduit 120; the fluid then exits the outlet conduit 120 into the atmosphere.

In alternative embodiments, the adjustable air mattress 100 may be portable and capable of being rolled up or folded. The adjustable air mattress 100 may also be integrated onto the surface of a vehicle. For example, the adjustable air mattress 100 may be integrated into the truck bed of the vehicle or the roof of the vehicle. The adjustable air mattress 100 may also be integrated into a tent, sleeping bag, or any other desired object.

It is noted that the term "about" may be utilized herein to represent the inherent degree of uncertainty that may be attributed to any quantitative comparison, value, measurement, or other representation. This terms is also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An adjustable air mattress, comprising:

a plurality of air chambers having a sleeping surface;

an electronic control unit;

an air pump communicatively coupled to the electronic control unit, the air pump is fluidly coupled to the plurality of air chambers; and a plurality of level sensors communicatively coupled to the electronic control unit, the plurality of level sensors determine an angle of the sleeping surface; wherein:

the plurality of level sensors determine whether the angle of the sleeping surface is within a predetermined level range; and when it is determined that the angle of the sleeping surface is not within the predetermined level range, the electronic control unit controls the air pump to adjust an amount of air in at least one of the plurality of air chambers.

2. The adjustable air mattress of claim 1, further comprising a plurality of pressure sensors communicatively coupled to the electronic control unit.

3. The adjustable air mattress of claim 1, wherein the air pump is configured to either direct air into the plurality of air chambers or pull air out of the plurality of air chambers.

4. The adjustable air mattress of claim 1, further comprising an outlet conduit fluidly coupled to the plurality of air chambers, wherein the outlet conduit releases air out of the plurality of air chambers through a plurality of air valves.

5. The adjustable air mattress of claim 1, wherein the air pump is integrated into the adjustable air mattress.

6. The adjustable air mattress of claim 5, wherein a battery is integrated into the adjustable air mattress.

7. The adjustable air mattress of claim 1, wherein there are two layers of the plurality of air chambers below the sleeping surface.

8. The adjustable air mattress of claim 7, wherein the plurality of level sensors are inclinometers.

9. The adjustable air mattress of claim 1, wherein the electronic control unit is configured to allow a user to set the sleeping surface to be adjusted to a predetermined angle other than level.

10. The adjustable air mattress of claim 1, further comprising a plurality of height sensors communicatively coupled to the electronic control unit, each of the plurality of height sensors measure a height of each of the plurality of air chambers, wherein the electronic control unit is configured to inhibit air from being removed from one of the plurality of air chambers when a height of the one of the plurality of air chambers is less than a predetermined minimum height.

* * * * *